US012710243B2

(12) United States Patent
Knowlen et al.

(10) Patent No.: US 12,710,243 B2
(45) Date of Patent: Aug. 18, 2026

(54) RAM ACCELERATOR SWEEPER BAFFLES

(71) Applicant: University of Washington, Seattle, WA (US)

(72) Inventors: Carl Thomas Knowlen, Seattle, WA (US); Andrew Jason Higgins, Seattle, WA (US); Brian Leege, Seattle, WA (US)

(73) Assignee: University of Washington, Seattle, WA (US)

( * ) Notice: Subject to any disclaimer, the term of this patent is extended or adjusted under 35 U.S.C. 154(b) by 0 days.

(21) Appl. No.: 18/844,803

(22) PCT Filed: Mar. 10, 2023

(86) PCT No.: PCT/US2023/064196
§ 371 (c)(1),
(2) Date: Sep. 6, 2024

(87) PCT Pub. No.: WO2024/026156
PCT Pub. Date: Feb. 1, 2024

(65) Prior Publication Data

US 2025/0189251 A1 Jun. 12, 2025

Related U.S. Application Data

(60) Provisional application No. 63/318,886, filed on Mar. 11, 2022.

(51) Int. Cl.
*F41A 1/02* (2006.01)
*F41A 21/16* (2006.01)
*F41A 21/30* (2006.01)

(52) U.S. Cl.
CPC ..... *F41A 21/16* (2013.01)

(58) Field of Classification Search
CPC ..... F41A 1/02; F41A 1/04; F41A 21/28
See application file for complete search history.

(56) References Cited

U.S. PATENT DOCUMENTS 569,191 A * 10/1896 Gathmann ..... F41A 1/04 89/14.05
958,934 A * 5/1910 Maxim ..... F41A 21/30 89/14.4

(Continued)

FOREIGN PATENT DOCUMENTS

DE 3808655 9/1989
WO 2016057707 A2 4/2016

(Continued)

OTHER PUBLICATIONS

Anonymous, "Projectiles", University of Washington—College of Engineering, (Apr. 12, 2021), University of Washington—College of Engineering, URL: https://web.archive.org/web/20210412000930/https://www.aa.washington.edu/research/ramaccel/projectiles, (Apr. 9, 2024), XP093149717.

(Continued)

*Primary Examiner* — Derrick R Morgan
(74) *Attorney, Agent, or Firm* — Christensen O'Connor Johnson Kindness PLLC

(57) ABSTRACT

A ram accelerator for accelerating a projectile is provided. The ram accelerator includes a first tube body having a first projectile bore, a second tube body having a second projectile bore axially aligned with the first projectile bore, and a baffle positioned between and operably coupling the first and second tube bodies. The baffle can have an annular baffle wall defining a central bore that is axially aligned with the first and second projectile bores, and a chamber arranged adjacent to the annular baffle wall. The chamber can extend radially outward from the central bore and the annular baffle wall can be configured to sweep a combustion wave relative (Continued)

to the projectile to prevent the combustion wave from traveling ahead of the projectile, leading to an unstart mechanism of the projectile in the ram accelerator.

22 Claims, 5 Drawing Sheets

(56) References Cited

U.S. PATENT DOCUMENTS

| | | | | | |
|---|---|---|---|---|---|
| 1,173,687 | A * | 2/1916 | Thompson | F41A 21/30 | 89/14.4 |
| 1,259,251 | A * | 3/1918 | Love | F41A 21/30 | 89/14.3 |
| 2,780,962 | A * | 2/1957 | Ressler | F41A 21/30 | 89/14.2 |
| 3,713,362 | A * | 1/1973 | Charron | F41A 21/30 | 89/14.4 |
| 3,776,093 | A * | 12/1973 | Leverance | F41A 21/34 | 89/14.4 |
| 4,024,791 | A * | 5/1977 | Stratman | F41A 21/34 | 89/14.2 |
| 4,480,523 | A * | 11/1984 | Young | F41B 6/006 | 89/8 |
| 4,530,417 | A * | 7/1985 | Daniel | F41A 21/30 | 181/252 |
| 4,939,977 | A * | 7/1990 | Stroup | F41A 21/30 | 89/14.4 |
| 4,949,621 | A * | 8/1990 | Stephens | F41A 1/04 | 89/7 |
| 4,982,647 | A * | 1/1991 | Hertzberg | F41A 1/04 | 89/8 |
| 5,078,043 | A * | 1/1992 | Stephens | F41A 21/30 | 89/14.4 |
| 5,097,743 | A * | 3/1992 | Hertzberg | F41A 1/02 | 89/7 |
| 5,394,805 | A | 3/1995 | Giraud | | |
| 5,578,783 | A | 11/1996 | Brandeis | | |
| 5,841,058 | A * | 11/1998 | Manis | F41A 21/00 | 42/76.01 |
| 7,237,467 | B1 * | 7/2007 | Melton | F41A 21/34 | 89/14.4 |
| 7,775,148 | B1 | 8/2010 | Mcdermott | | |
| 9,366,495 | B1 * | 6/2016 | Coppinger | F41A 21/30 | |
| 9,988,844 | B2 | 6/2018 | Russell | | |
| 10,054,384 | B1 * | 8/2018 | Marfione | F41A 21/30 | |
| 10,119,779 | B1 * | 11/2018 | Miele | F41A 21/30 | |
| 10,267,586 | B1 * | 4/2019 | Marfione | F41A 21/30 | |
| 10,281,228 | B1 * | 5/2019 | Marfione | F41A 21/30 | |
| 10,502,512 | B1 * | 12/2019 | Beaudry | F41A 21/28 | |
| 10,852,081 | B2 * | 12/2020 | Knowlen | F41A 1/02 | |
| 10,852,091 | B1 * | 12/2020 | Helms | F41A 21/30 | |
| 11,585,623 | B2 * | 2/2023 | Borunsky | F41A 21/30 | |
| 11,927,412 | B1 * | 3/2024 | Kunsky | F41A 21/30 | |
| 2011/0056111 | A1 * | 3/2011 | Brittingham | F41A 21/30 | 29/557 |
| 2014/0076658 | A1 * | 3/2014 | Smith, II | F41A 21/30 | 181/223 |
| 2014/0224575 | A1 * | 8/2014 | Latka | F41A 21/30 | 156/60 |
| 2015/0001002 | A1 * | 1/2015 | Wirth | F41A 21/30 | 181/223 |
| 2015/0276340 | A1 * | 10/2015 | Vais | F41A 21/30 | 181/223 |
| 2015/0330147 | A1 | 11/2015 | Russell | | |
| 2016/0018177 | A1 * | 1/2016 | Powell | F41A 21/30 | 89/14.4 |
| 2016/0356087 | A1 | 12/2016 | Russell | | |
| 2017/0074613 | A1 * | 3/2017 | Shults | F41A 21/30 | |
| 2017/0130531 | A1 | 5/2017 | Russell | | |
| 2017/0307313 | A1 * | 10/2017 | Knowlen | F41A 1/02 | |
| 2018/0073301 | A1 | 3/2018 | Russell | | |
| 2018/0299223 | A1 * | 10/2018 | Barrett | F41A 21/30 | |
| 2019/0226787 | A1 * | 7/2019 | Orne | F41A 21/30 | |
| 2020/0031500 | A1 * | 1/2020 | Russell | B64G 1/646 | |
| 2021/0180893 | A1 * | 6/2021 | Knowlen | F41F 1/00 | |
| 2021/0341247 | A1 * | 11/2021 | Bowers | F41A 21/30 | |
| 2021/0381792 | A1 * | 12/2021 | Young | F41A 21/30 | |
| 2021/0396485 | A1 * | 12/2021 | Reis-Green | F41A 21/30 | |
| 2022/0034619 | A1 * | 2/2022 | Tiziani | F41A 21/30 | |
| 2022/0163281 | A1 * | 5/2022 | Madigan | F41A 21/30 | |
| 2023/0100384 | A1 * | 3/2023 | Kunsky | F41A 21/30 | 89/14.4 |
| 2023/0266088 | A1 * | 8/2023 | Edminster | F41A 21/30 | 89/14.4 |
| 2023/0296344 | A1 * | 9/2023 | Graham, II | F41A 21/325 | 89/14.4 |
| 2024/0159488 | A1 * | 5/2024 | Sims | F41A 21/30 | |
| 2024/0175654 | A1 * | 5/2024 | Mourning, II | F41A 21/30 | |
| 2024/0255248 | A1 * | 8/2024 | Kunsky | F41A 21/30 | |
| 2024/0344798 | A1 * | 10/2024 | Reints | F41A 21/30 | |
| 2025/0237443 | A1 * | 7/2025 | Knowlen | F41A 1/02 | |
| 2025/0244095 | A1 * | 7/2025 | Naumu | F41A 21/30 | |

FOREIGN PATENT DOCUMENTS

| | | | |
|---|---|---|---|
| WO | 2016065164 | A1 | 4/2016 |
| WO | 2016172381 | A1 | 10/2016 |
| WO | 2023220504 | | 11/2023 |

OTHER PUBLICATIONS

Schultz, E., Knowlen, C., and Bruckner, A.P., (2000) "Starting Envelope of the Subdetonative Ram Accelerator," J. of Propulsion & Power, 16(6):1040-1052.

Bogdanoff, D.W. (1998) "Ram accelerator optimization and use of hydrogen core to increase projectile velocity," In: Takayama K., Sasoh A. (eds) Ram Accelerators, Springer, Berlin, Heidelberg. https://doi.org/10.1007/978-3-642-46876-6_16.

Brian J. Leege et al,. "Baffled Tube Ram Accelerator Operation with Normal Baffles", Jan. 2022, Aerospace Research Central, Entire Document, <https://arc.aiaa.org/doi/epdf/10.2514/6.2022-2071>. (Year: 2022).

Brian J. Leege et al., "Ram Accelerator Operation in Railed and Baffled Tubes", Aug. 2020, Aerospace Research Central, Entire Document, <https://arc.aiaa.org/doi/epdf/10.2514/6.2020-3516>. (Year: 2020).

* cited by examiner

RAM ACCELERATOR SWEEPER BAFFLES

CROSS-REFERENCE TO RELATED APPLICATION

This application is a National Stage of International Application No. PCT/US2023/064196, filed Mar. 10, 2023, which claims the benefit of Provisional Application No. 63/318,886, filed Mar. 11, 2022, the disclosure disclosures of which are hereby incorporated by reference herein in their entirety for all purposes

BACKGROUND

A ram accelerator accelerates projectiles to extremely high velocities using jet-engine-like propulsion cycles based on ramjet and/or scramjet combustion processes. The device operates by propelling a projectile through a stationary tube filled with a combustible gaseous propellant mixture. The ram accelerator may be suitable for use in applications involving large payloads, such as non-rocket space launch.

In conventional powder-propelled firearms, propellant is burned behind the projectile in a breech, generating high pressure gas which expands as it pushes the projectile down the barrel. As the projectile moves faster, the propelling gas must expend more energy to continue accelerating the projectile. However, once the projectile reaches a critical velocity, the propellant gas exerts only enough force to overcome friction, and thereafter the projectile begins to slow down if the barrel is too long.

Conversely, a ram accelerator functions by filling a launch tube (barrel) with propellant to accelerate the projectile. With a properly shaped projectile/tube, a unique propulsive cycle can be initiated in which the projectile compresses and ignites the propellant as it travels through the tube. This results in a combustion pulse being accelerated down the tube, where the combustion pulse is self-synchronized with the tailing end of the projectile. In use, the projectile rides its own combustion wave down the length of the launch tube, allowing the projectile to accelerate to speeds far greater than can be achieved by a conventional powder-propelled firearm.

DESCRIPTION OF THE DRAWINGS

The foregoing aspects and many of the attendant advantages of the claimed subject matter will become more readily appreciated as the same become better understood by reference to the following detailed description, when taken in conjunction with the accompanying drawings, wherein:

DETAILED DESCRIPTION

The detailed description set forth above in connection with the appended drawings, where like numerals reference like elements, are intended as a description of various embodiments of the present disclosure and are not intended to represent the only embodiments. Each embodiment described in this disclosure is provided merely as an example or illustration and should not be construed as preferred or advantageous over other embodiments. The illustrative examples provided herein are not intended to be exhaustive or to limit the disclosure to the precise forms disclosed.

As will be described in more detail below, the present disclosure provides examples of ram accelerators that are capable of accelerating a projectile to relatively high velocities. The ram accelerators of the present disclosure include a plurality of sweeper baffles disposed along the axial length of the projectile bore of the ram accelerator. In some embodiments, the axial distance between the sweeper baffles or sweeper baffle assemblies is longer than the shoulder of the projectile. These and other use case examples described herein should not be considered limiting to the scope of the present disclosure.

Although embodiments of the present disclosure may be described with reference to a configuration of a ram accelerator having three groups of two baffle members, as shown in the FIGURES, one skilled in the relevant art will appreciate that the disclosed embodiments are illustrative in nature and therefore should not be construed as limited to such an application. It should therefore be apparent that the disclosed technologies and methodologies have wide application, and therefore may be suitable for use with any suitable number of groups of baffle members, any number of baffle members in a group (including a single baffle member), or baffle members having different shapes, number of chambers, etc. Further, the baffles can be integrated into the projectile bore rather than projecting from a separate member. Accordingly, the following descriptions and illustrations herein should not limit the scope of the claimed subject matter.

Figure 1:
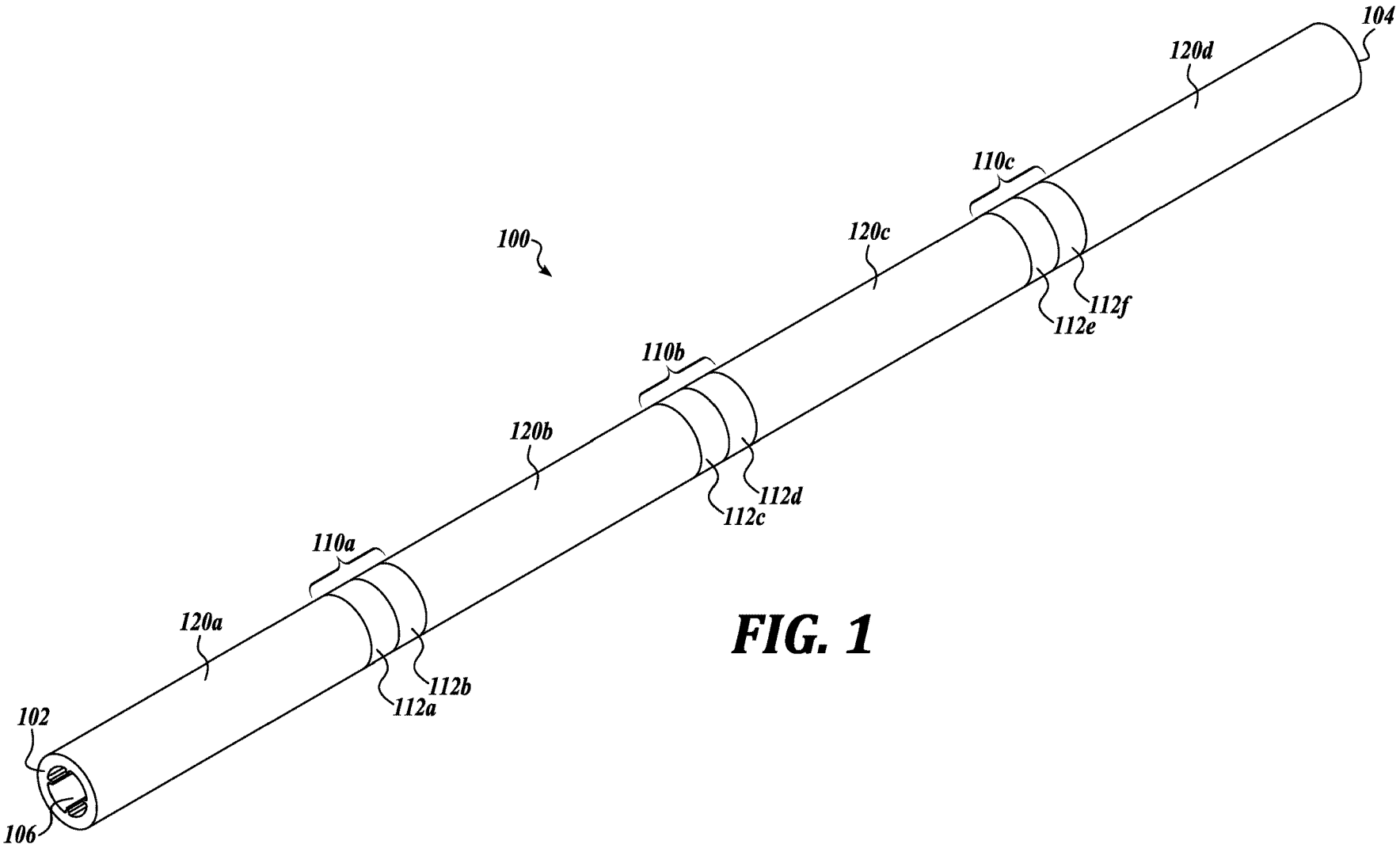
FIG. 1 is a perspective view of an embodiment of a ram accelerator having a plurality of sweeper baffles formed in accordance with aspects of the present disclosure.
Figure 2A:
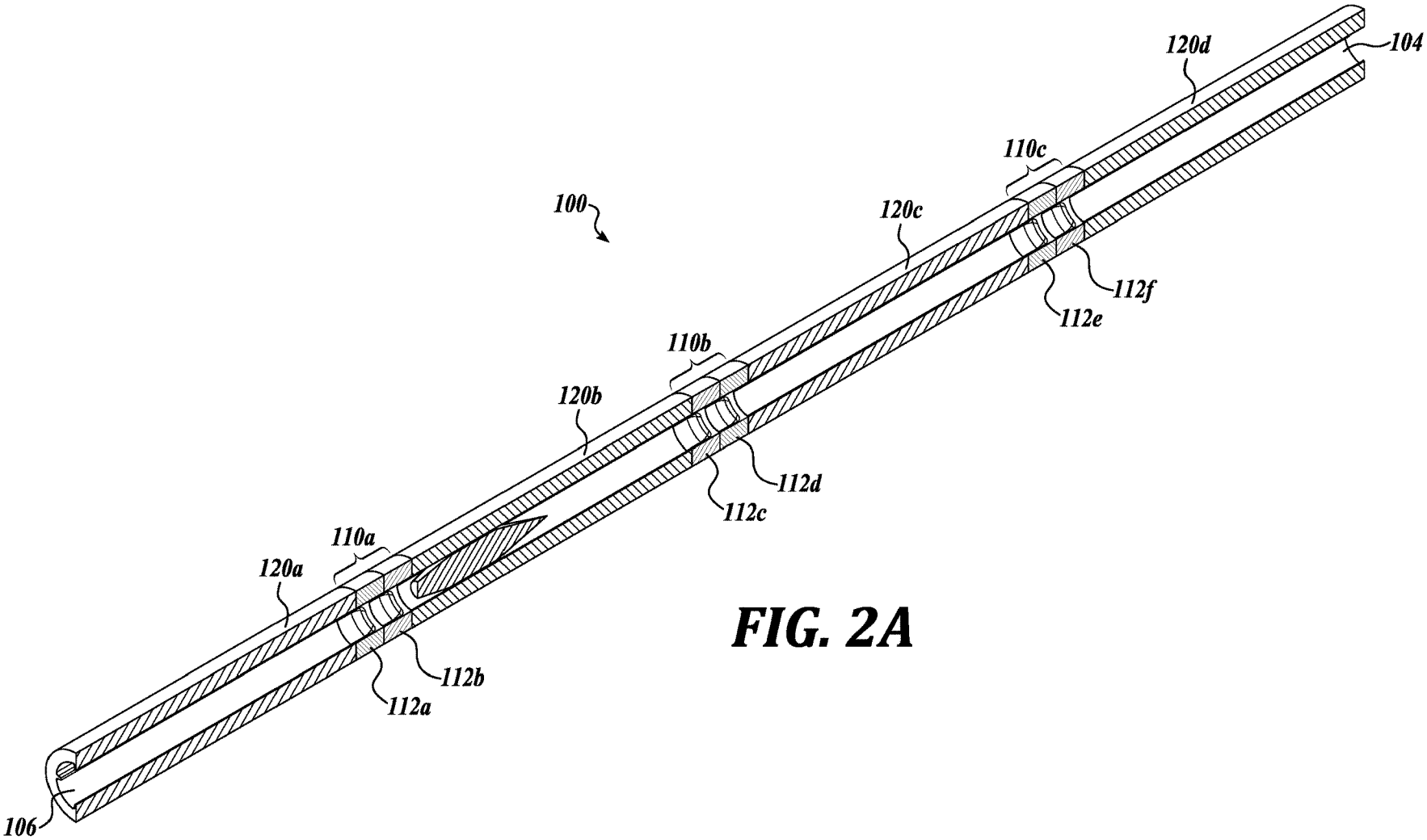
FIGS. 2A and 2B are perspective and side cross-sectional views of the ram accelerator of FIG. 1.
Figure 2B:
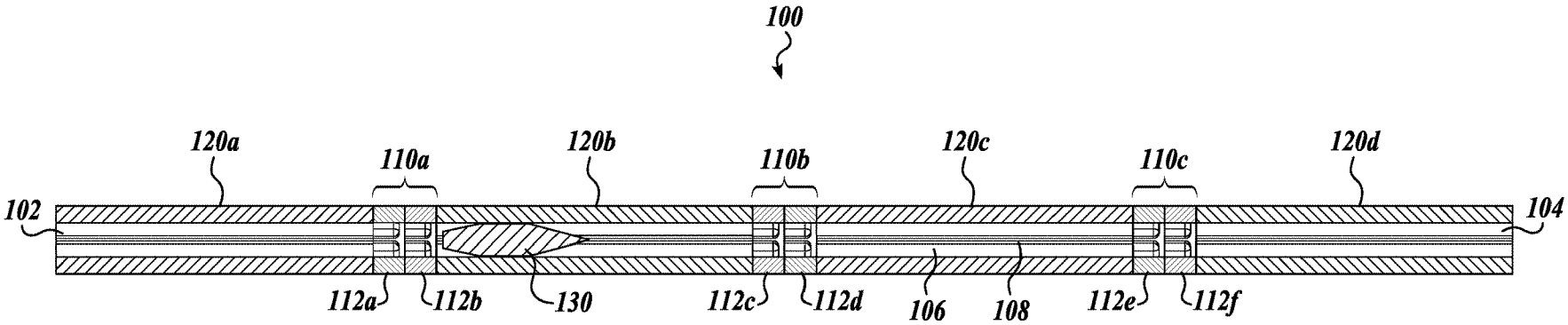

FIG. 1 is a perspective view of an embodiment of a ram accelerator assembly 100 ("assembly 100") having a plurality of baffle groups 110 (denoted 110*a*-110*c* in the FIGURES), and FIGS. 2A and 2B are perspective and side cross-sectional views of the assembly 100, each formed in accordance with aspects of the present disclosure. The assembly 100 has a projectile inlet 102 at a proximal end of the baffle groups 110, a projectile outlet 104 at a distal end of the assembly 100, and a projectile bore 106 extending axially through the assembly 100, through which an accelerated projectile 130 (see FIGS. 2A and 2B) travels during use of the assembly 100. Although not shown, the projectile inlet 102, the projectile outlet 104, and/or the transition between the baffle groups 110 and the tube segments 120 can include frangible diaphragms or a fast-actuating valves that opens prior to projectile arrival.

As shown in FIGS. 1, 2A, and 2B, each baffle group 110 can include one or more baffle members 112 (denoted 112*a*-112*f* in the FIGURES), the features of which will be described in detail with reference to FIGS. 3A and 3B below. As noted above, although six baffle members 112*a*-112*f* are shown in three baffle groups 110*a*-110*c* in the FIGURES (with the baffle group 110*a* containing the baffle members 112*a* and 112*b*, the baffle group 110*b* containing the baffle members 112*c* and 112*d*, and the baffle group 110*c* containing the baffle members 112*e* and 112*f*), the embodiments described herein may be suitable for use with any number of baffle members and in any group configuration to sweep the forward moving combustion wave backwards to keep the wave from advancing into the projectile through region. In other embodiments, the baffle groups 110 are formed from a single component, formed in a clamshell configuration, or the baffle members can include multiple baffles (e.g., a single baffle member with two baffles spaced apart along the axial length of the assembly 100). The number of baffles and the spacing thereof can be adjusted to accommodate a variety of projectile calibers, velocities, and ram accelerator configurations.

The assembly 100 can also include a plurality of tube segments 120 (denoted 120*a*-120*c* in the FIGURES), which can separate the assembly 100 into smaller sections to aid in, e.g., transportation, manufacturing, storage, assembly, cost, etc. In a similar manner to the baffle members 112, any number of tube segments 120 can be used to form the tube of the assembly 100, including a single tube segment with integrated baffles (e.g., the configuration shown in FIG. 4). In some embodiments, the tube segments 120 are railed, e.g., including a rail 108 shown in FIG. 2B, such that an axisymmetric projectile can be guided through the projectile bore 106 by the rail 108. In other embodiments, the tube segments 120 are smooth-bored and a finned projectile (not shown) can be guided through the projectile bore 106 by protruding fins on the projectile. As described above, any number of baffle members can be positioned between the tube segments 120 to sweep back combustion-driven waves to avoid unstarting the projectile 130.

The embodiments described herein are suitable for use with any conventional starting process for a ram accelerator, e.g., using a tube-occluding obturator that compresses residual launch tube gas through multiple shock reflections between the projectile and entrance closure (e.g., the frangible diaphragm or fast-actuating valve that opens prior to projectile arrival). The obturator can produce a region of hot gas that ignites the propellant as the projectile enters the ram accelerator. In these conventional starting processes, the obturator mass and geometry are tuned to enable operation of the obturator in the proximity of the projectile for sufficient duration to establish combustion behind the projectile, and then are rapidly decelerated after propellant ignition to allow the combustion products to expand as the projectile travels toward the outlet and keep the combustion driven shock wave from unstarting the projectile. These conventional configurations require a two-piece projectile assembly with the obturator having parasitic mass that increases the requisite launch gun breech pressure. Additionally, the obturator must be blown down and out of the tube or otherwise removed from the system prior to reloading propellant and re-firing the ram accelerator.

In conventional ram accelerators, it can be challenging to stabilize the system for useful velocity gains because the projectile has a cylindrical shoulder which results in the flow region of minimum cross-section being constant area for several projectile diameters. The flow region of minimum area is referred to as the projectile throat. During operation of the conventional ram accelerator, the combustion wave moves forward and into the throat region, which then chokes the flow and drives a strong shock wave ahead of the projectile. As the flow is choked and the shock wave travels ahead of the projectile, the ram accelerator experiences an unstart mechanism resulting in the cessation of thrust. In one configuration, a diluent can be added to the propellant, to delay the unstart mechanism, but ultimately choking in the throat region still limits the upper Mach number and the lower energy content of the propellant reduces the thrust throughout the corresponding operational envelope.

The baffle groups 110 include baffle members 112 that are configured to sweep the moving combustion wave backward to keep the wave from advancing into the projectile throat region (i.e., avoiding the unstart mechanism of conventional ram accelerators). The axially spaced baffle groups 110 can form sweeper stations that enable the assembly 100 to continuously operate with the combustion-driven shock wave system surging forward without being pushed ahead of the projectile 130. Sweeping the wave with the baffle groups 110 allows a more energetic propellant to be used in the assembly 100, which can increase the thrust at a given fill pressure while expanding the operational Mach number envelope of the assembly 100. In some embodiments, the thrust can be up to double that of a conventional ram accelerator without the sweeper baffle groups 110 in the configuration of the present disclosure.

Figure 3B:
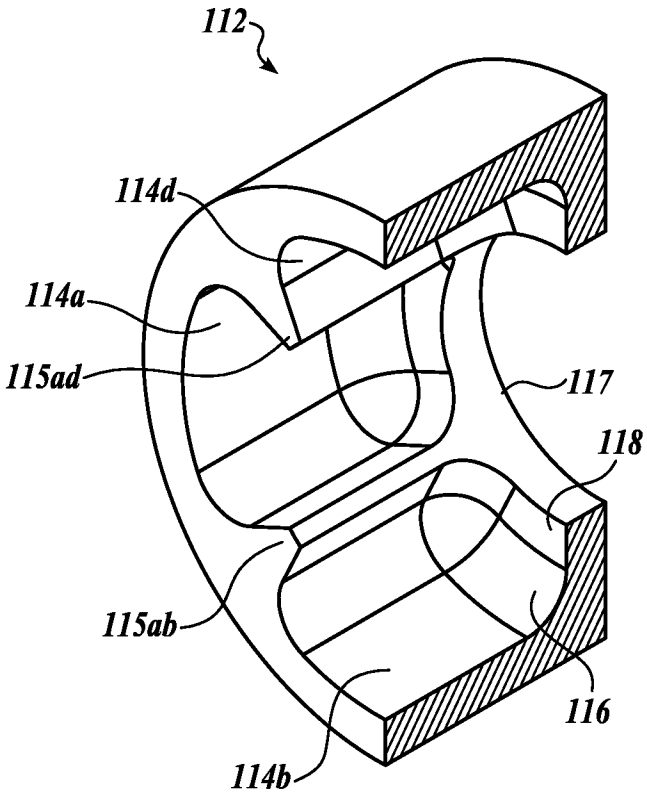
FIGS. 3A and 3B are perspective and cross-sectional views of a sweeper baffle of the ram accelerator of FIG. 1.
Figure 3A:
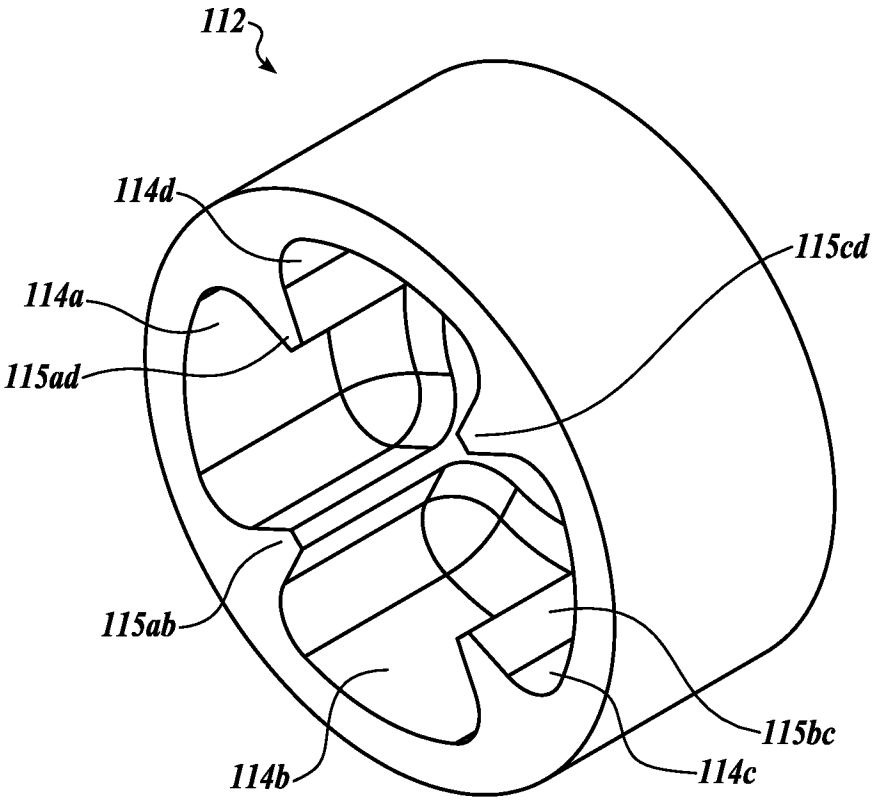

Turning now to FIGS. 3A and 3B, there is shown perspective and cross-sectional views of an individual baffle member 112 of the baffle groups 110 in accordance with aspects of the present disclosure. The baffle member 112 includes chambers 114 (with four chambers denoted 114*a*-114*d* in FIG. 3A), in which combustion gasses can expand. Although four chambers 114*a*-114*d* are shown, in other embodiments any number of chambers may be suitable for use with the assembly 100, e.g., one, two, three, five, or greater. The chambers 114 are separated by radially inwardly projecting fins 115 between each chamber 114, with a first fin 115*ab* separating first and second chambers 114*a* and 114*b*, a second fin 115*bc* separating the second chamber 114*b* and a third chamber 114*c*, and so on.

As shown in FIG. 3B, the baffle member 112 can include a central bore 117 through which the projectile 130 travels during acceleration of the projectile 130 through the assembly 100. The central bore 117 can be sized and configured to be closely concentric with the caliber size of the projectile 130 such that the combustion wave is swept backward from the projectile 130 to keep the wave from advancing into the projectile throat region, unstarting the projectile 130. Each of the chambers 114 can further include an annular baffle wall 118 adjacent to the central bore 117, and a transitional wall 116 configured to increase the axial strength of the annular baffle wall 118 during use, and to direct the combustion pressure waves axially toward the inlet 102 as the projectile 130 passes through the baffle member 112.

Figure 4:
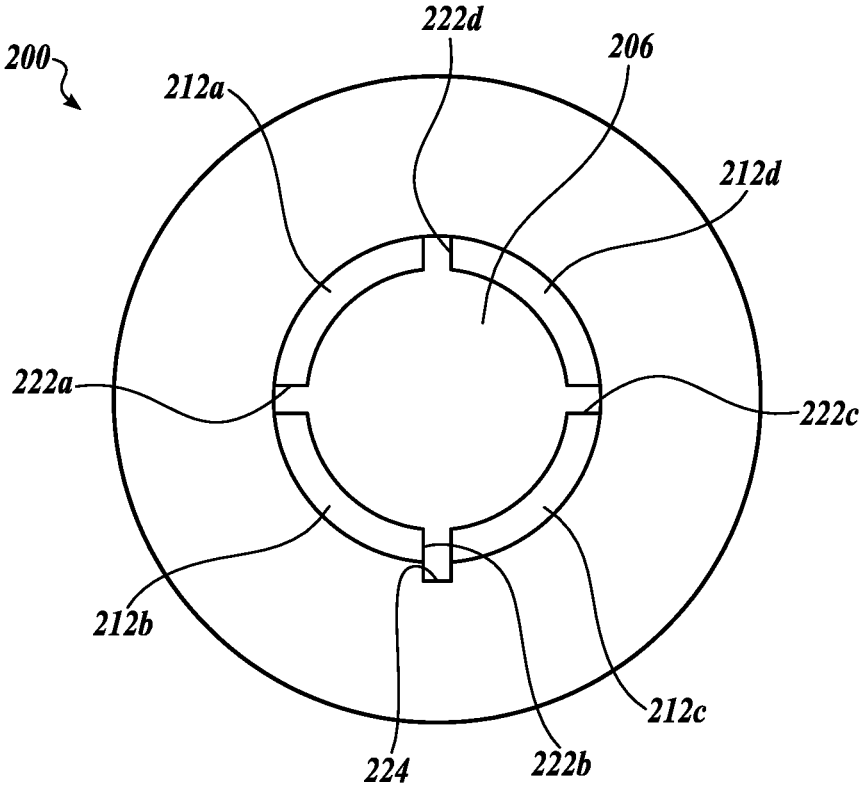
FIG. 4 is a front view of a sweeper baffle for use with a smooth-bored ram accelerator in accordance with aspects of the present disclosure.

FIG. 4 is a front view of a sweeper baffle 212 positioned in a smooth-bored ram accelerator assembly 200 in accordance with aspects of the present disclosure. The sweeper baffle 212 can be integrated into a projectile bore 206 of a tube body 220. In these embodiments, the sweeper baffle 212 can be a radially inward projection spaced at intervals in the axial direction along the tube body 220, e.g., in a similar spacing as shown in the assembly 100 of FIGS. 1-2B. In other embodiments, the sweeper baffles 212 can be positioned in any configuration along the axial length of the tube body 220, and can be positioned at a constant axial distance or at varying axial distances from one another depending on the position of the sweeper baffle 212 in the tube body 220. For example, the sweeper baffles 212 may be positioned closer together near the inlet end of the assembly 200 when the projectile has not yet reached the higher velocities (where the combustion gases would more likely travel into the throat region and unstart the projectile), and then be positioned farther apart near the outlet end of the assembly 200. In other embodiments, the sweeper baffles 212 can be grouped together similar to the baffle groups 110 of the assembly 100, or the sweeper baffles can be positioned evenly along the axial length of the tube body 220.

As described above, in smooth-bored ram accelerators, the projectile utilizes fins (not shown) to keep the subcaliber projectile centered in the projectile bore 206. In this regard, the sweeper baffles 212 can be sectioned into first (212*a*), second (212*b*), third (212*c*), and fourth (212*d*) sweeper baffle sections. In these configurations, the sweeper baffles 212 can include notches 222 positioned between each of the sweeper baffle sections 212*a*-212*d* (with the notch 222*ab* positioned between the sweeper baffle sections 212*a* and 212*b*, the notches 222*bc* positioned between the sweeper baffle sections 212*b* and 212*c*, and so on). The notches 222 can be sized and positioned such that the fins of the projectile can pass through the notches 222 without impacting the sweeper baffles 212. In these embodiments, the projectile orientation about the axis of travel must be constrained by a keyway 224 or other feature to keep the fins aligned with the notches 222 between he baffle sections 212*a*-212*d*.

A collection of exemplary embodiments, including at least some explicitly enumerated as "ECs" (Example Combinations), providing additional description of a variety of embodiment types in accordance with the concepts described herein are provided below. These examples are not meant to be mutually exclusive, exhaustive, or restrictive, and the claimed subject matter is not limited to these example embodiments but rather encompasses all possible modifications and variations within the scope of the issued claims and their equivalents.

EC A. A ram accelerator for accelerating a projectile, the ram accelerator comprising: a first tube body having a first projectile bore; a second tube body having a second projectile bore axially aligned with the first projectile bore; a baffle positioned between and operably coupling the first and second tube bodies, the baffle having an annular baffle wall defining a central bore that is axially aligned with the first and second projectile bores, and a chamber arranged adjacent to the annular baffle wall, wherein the chamber extends radially outward from the central bore, wherein the annular baffle wall is configured to sweep a combustion wave relative to the projectile to prevent the combustion wave from traveling ahead of the projectile.

EC B. The ram accelerator of EC A., wherein the baffle has a first baffle member and a second baffle member arranged axially in a series, and wherein each of the baffle members includes at least one annular baffle wall and at least one chamber.

EC C. The ram accelerator of EC A., wherein the chamber is a first chamber, and wherein the baffle further comprises a second chamber separated from the first chamber by a radially inwardly projecting fin.

EC D. The ram accelerator of EC C., wherein the baffle section further comprises a third chamber and a fourth chamber, each of the first, second, third, and fourth chambers being separated from each other by a radially inwardly projecting fin.

EC E. The ram accelerator of EC A., wherein the baffle is a first baffle, the annular baffle wall is a first annular baffle wall, the central bore is a first central bore and the chamber is a first chamber, and wherein the ram accelerator further comprises: a third tube body having a third projectile bore axially aligned with the first and second projectile bores; a second baffle positioned between and operably coupling the second and third tube bodies, the second baffle having a second annular baffle wall defining a second central bore that is axially aligned with the second and third projectile bores, and a second chamber arranged adjacent to the second annular baffle wall, wherein the second chamber extends radially outward from the second central bore, wherein the second annular baffle wall is configured to sweep the combustion wave relative to the projectile to prevent the combustion wave from traveling ahead of the projectile.

EC F. The ram accelerator of EC E., wherein: the first baffle has two baffle members arranged axially in a series; the second baffle has two baffle members arranged axially in a series; and each of the baffle members includes at least one annular baffle wall and at least one chamber.

EC G. The ram accelerator of EC A., further comprising: a fourth tube body having a fourth projectile bore axially aligned with the first, second, and third projectile bores; a third baffle positioned between and operably coupling the third and fourth tube bodies, the third baffle having a third annular baffle wall defining a third central bore that is axially aligned with the third and fourth projectile bores, and a third chamber arranged adjacent to the third annular baffle wall, wherein the third chamber extends radially outward from the third central bore, wherein the third annular baffle wall is configured to sweep the combustion wave relative to the projectile to prevent the combustion wave from traveling ahead of the projectile.

EC H. The ram accelerator of EC G., wherein: the first baffle has two baffle members arranged axially in a series, the second baffle has two baffle members arranged axially in a series; the second baffle has two baffle members arranged axially in a series, and each of the baffle members includes at least one annular baffle wall and at least one chamber.

EC I. The ram accelerator of EC E., wherein the first tube body is axially shorter than the second tube body.

EC J. The ram accelerator of EC G., wherein the first tube body is axially shorter than the second tube body, and wherein the second tube body is axially shorter than the third tube body.

EC K. The ram accelerator of EC A., wherein the central bore is smaller in diameter than the first and second projectile bores.

EC L. The ram accelerator of EC A., wherein the ram accelerator is a railed-tube ram accelerator, wherein the first tube body further comprises a first rail and the second tube body further comprises a second rail, and wherein the first and second rails are configured to guide the projectile through the first and second projectile bores.

EC M. A ram accelerator for accelerating a projectile, the ram accelerator comprising: a tube body having a projectile bore, a sweeper baffle projecting radially inward into the projectile bore, the sweeper baffle forming an annular baffle wall defining a central bore that is axially aligned with and a smaller diameter than the projectile bore, wherein the annular baffle wall is configured to sweep a combustion wave relative to the projectile to prevent the combustion wave from traveling ahead of the projectile.

EC N. The ram accelerator of EC M., wherein: the sweeper baffle is a first sweeper baffle, the annular baffle wall is a first annular baffle wall, and the central bore is a first central bore; the ram accelerator further comprises a second baffle projecting radially inward into the projectile bore and spaced apart axially from the first sweeper baffle, the second sweeper baffle forming a second annular baffle wall defining a second central bore that is axially aligned with and a smaller diameter than the projectile bore; and the second annular baffle wall is configured to sweep the combustion wave relative to the projectile to prevent the combustion wave from traveling ahead of the projectile.

EC O. The ram accelerator of EC M., wherein the ram accelerator is a smooth-bored ram accelerator, and wherein the sweeper baffle comprises a notch corresponding to a position of a fin of the projectile such that the fin passes through the notch as the projectile passes the sweeper baffle.

EC P. The ram accelerator of EC O., wherein the projectile bore further comprises a keyway corresponding to a position of a key fin of the projectile, and wherein the keyway aligns with the notch of the sweeper baffle.

EC Q. The ram accelerator of EC O., wherein the notch is a first notch, and wherein the sweeper baffle further comprises: a second notch corresponding to a position of a second fin of the projectile; a third notch corresponding to a position of a third fin of the projectile; and a fourth notch corresponding to a position of a fourth fin of the projectile, wherein each of the first, second, third, and fourth are configured such that the corresponding first, second, third, and fourth fin passes through the notch as the projectile passes the sweeper baffle.

EC R. The ram accelerator of EC M., further comprising a third baffle projecting radially inward into the projectile bore and spaced apart axially from the first and second sweeper baffles, the third sweeper baffle forming a third annular baffle wall defining a third central bore that is axially aligned with and a smaller diameter than the projectile bore; and the third annular baffle wall is configured to sweep the combustion wave relative to the projectile to prevent the combustion wave from traveling ahead of the projectile.

EC S. The ram accelerator of EC R., wherein the first sweeper baffle is spaced axially closer to the second sweeper baffle than the second sweeper baffle is spaced axially from the third sweeper baffle.

EC T. The ram accelerator of EC M., wherein an axial distance between the first sweeper baffle and the second sweeper baffle is the same as an axial distance between the second sweeper baffle and the third sweeper baffle.

In the foregoing description, specific details are set forth to provide a thorough understanding of exemplary embodiments of the present disclosure. It will be apparent to one skilled in the art, however, that the embodiments disclosed herein may be practiced without embodying all of the specific details. In some instances, well-known process steps have not been described in detail in order not to unnecessarily obscure various aspects of the present disclosure. Further, it will be appreciated that embodiments of the present disclosure may employ any combination of features described herein.

The present application may reference quantities and numbers. Unless specifically stated, such quantities and numbers are not to be considered restrictive, but exemplary of the possible quantities or numbers associated with the present application. Also in this regard, the present application may use the term "plurality" to reference a quantity or number. In this regard, the term "plurality" is meant to be any number that is more than one, for example, two, three, four, five, etc. The terms "about," "approximately," "near," etc., mean plus or minus 10% of the stated value. For the purposes of the present disclosure, the phrase "at least one of A and B" is equivalent to "A and/or B" or vice versa, namely "A" alone, "B" alone or "A and B." Similarly, the phrase "at least one of A, B, and C," for example, means (A), (B), (C), (A and B), (A and C), (B and C), or (A, B, and C), including all further possible permutations when greater than three elements are listed.

It should be noted that for purposes of this disclosure, terminology such as "upper," "lower," "vertical," "horizontal," "fore," "aft," "inner," "outer," "front," "rear," etc., should be construed as descriptive and not limiting the scope of the claimed subject matter. Further, the use of "including," "comprising," or "having" and variations thereof herein is meant to encompass the items listed thereafter and equivalents thereof as well as additional items. Unless limited otherwise, the terms "connected," "coupled," and "mounted" and variations thereof herein are used broadly and encompass direct and indirect connections, couplings, and mountings.

Throughout this specification, terms of art may be used. These terms are to take on their ordinary meaning in the art from which they come, unless specifically defined herein or the context of their use would clearly suggest otherwise.

The principles, representative embodiments, and modes of operation of the present disclosure have been described in the foregoing description. However, aspects of the present disclosure, which are intended to be protected, are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure as claimed.

The embodiments of the invention in which an exclusive property or privilege is claimed are defined as follows:

1. A ram accelerator for accelerating a projectile, the ram accelerator comprising:

a first tube body having a first projectile bore;

a second tube body having a second projectile bore axially aligned with the first projectile bore; and a baffle positioned between and operably coupling the first and second tube bodies, the baffle having an annular baffle wall defining a central bore that is axially aligned with the first and second projectile bores, and a first chamber and a second chamber arranged adjacent to the annular baffle wall, wherein the first and second chambers extend radially outward from the central bore, wherein the second chamber is separated from the first chamber by a radially inwardly projecting fin, wherein the annular baffle wall is configured to sweep a combustion wave relative to the projectile to prevent the combustion wave from traveling ahead of the projectile.

2. The ram accelerator of claim 1, wherein the baffle has a first baffle member and a second baffle member arranged axially in a series, and wherein each of the baffle members includes at least one annular baffle wall and at least one chamber.

3. The ram accelerator of claim 1, wherein the baffle section further comprises a third chamber and a fourth chamber, each of the first, second, third, and fourth chambers being separated from each other by a radially inwardly projecting fin.

4. The ram accelerator of claim 1, wherein the baffle is a first baffle, the annular baffle wall is a first annular baffle wall, and the central bore is a first central bore, and wherein the ram accelerator further comprises:

a third tube body having a third projectile bore axially aligned with the first and second projectile bores;

a second baffle positioned between and operably coupling the second and third tube bodies, the second baffle having a second annular baffle wall defining a second central bore that is axially aligned with the second and third projectile bores, and a third chamber arranged adjacent to the second annular baffle wall, wherein the third chamber extends radially outward from the second central bore, wherein the second annular baffle wall is configured to sweep the combustion wave relative to the projectile to prevent the combustion wave from traveling ahead of the projectile.

5. The ram accelerator of claim 4, wherein:

the first baffle has two baffle members arranged axially in a series;

the second baffle has two baffle members arranged axially in a series; and each of the baffle members includes at least one annular baffle wall and at least one chamber.

6. The ram accelerator of claim 4, further comprising:

a fourth tube body having a fourth projectile bore axially aligned with the first, second, and third projectile bores;

a third baffle positioned between and operably coupling the third and fourth tube bodies, the third baffle having a third annular baffle wall defining a third central bore that is axially aligned with the third and fourth projectile bores, and a fourth chamber arranged adjacent to the third annular baffle wall, wherein the fourth chamber extends radially outward from the third central bore, wherein the third annular baffle wall is configured to sweep the combustion wave relative to the projectile to prevent the combustion wave from traveling ahead of the projectile.

7. The ram accelerator of claim 6, wherein:

the first baffle has two baffle members arranged axially in a series, the second baffle has two baffle members arranged axially in a series;

the second baffle has two baffle members arranged axially in a series; and each of the baffle members includes at least one annular baffle wall and at least one chamber.

8. The ram accelerator of claim 4, wherein the first tube body is axially shorter than the second tube body.

9. The ram accelerator of claim 6, wherein the first tube body is axially shorter than the second tube body, and wherein the second tube body is axially shorter than the third tube body.

10. The ram accelerator of claim 1, wherein the central bore is smaller in diameter than the first and second projectile bores.

11. The ram accelerator of claim 1, wherein the ram accelerator is a railed-tube ram accelerator, wherein the first tube body further comprises a first rail and the second tube body further comprises a second rail, and wherein the first and second rails are configured to guide the projectile through the first and second projectile bores.

12. A railed-tube ram accelerator for accelerating a projectile, the ram accelerator comprising:

a first tube body having a first projectile bore and a first rail;

a second tube body having a second projectile bore axially aligned with the first projectile bore and a second rail; and a baffle positioned between and operably coupling the first and second tube bodies, the baffle having an annular baffle wall defining a central bore that is axially aligned with the first and second projectile bores, and a chamber arranged adjacent to the annular baffle wall, wherein the chamber extends radially outward from the central bore, wherein the first and second rails are configured to guide the projectile through the first and second projectile bores, and wherein the annular baffle wall is configured to sweep a combustion wave relative to the projectile to prevent the combustion wave from traveling ahead of the projectile.

13. The railed-tube ram accelerator of claim 12, wherein the baffle has a first baffle member and a second baffle member arranged axially in a series, and wherein each of the baffle members includes at least one annular baffle wall and at least one chamber.

14. The railed-tube ram accelerator of claim 12, wherein the chamber is a first chamber, and wherein the baffle further comprises a second chamber separated from the first chamber by a radially inwardly projecting fin.

15. The railed-tube ram accelerator of claim 14, wherein the baffle section further comprises a third chamber and a fourth chamber, each of the first, second, third, and fourth chambers being separated from each other by a radially inwardly projecting fin.

16. The railed-tube ram accelerator of claim 1, wherein the baffle is a first baffle, the annular baffle wall is a first annular baffle wall, the central bore is a first central bore, and the chamber is a first chamber, and wherein the ram accelerator further comprises:

a third tube body having a third projectile bore axially aligned with the first and second projectile bores;

a second baffle positioned between and operably coupling the second and third tube bodies, the second baffle having a second annular baffle wall defining a second central bore that is axially aligned with the second and third projectile bores, and a second chamber arranged adjacent to the second annular baffle wall, wherein the second chamber extends radially outward from the second central bore, wherein the second annular baffle wall is configured to sweep the combustion wave relative to the projectile to prevent the combustion wave from traveling ahead of the projectile.

17. The railed-tube ram accelerator of claim 16, wherein:

the first baffle has two baffle members arranged axially in a series;

the second baffle has two baffle members arranged axially in a series; and each of the baffle members includes at least one annular baffle wall and at least one chamber.

18. The railed-tube ram accelerator of claim 16, further comprising:

a fourth tube body having a fourth projectile bore axially aligned with the first, second, and third projectile bores;

a third baffle positioned between and operably coupling the third and fourth tube bodies, the third baffle having a third annular baffle wall defining a third central bore that is axially aligned with the third and fourth projectile bores, and a third chamber arranged adjacent to the third annular baffle wall, wherein the third chamber extends radially outward from the third central bore, wherein the third annular baffle wall is configured to sweep the combustion wave relative to the projectile to prevent the combustion wave from traveling ahead of the projectile.

19. The railed-tube ram accelerator of claim 18, wherein:

the first baffle has two baffle members arranged axially in a series, the second baffle has two baffle members arranged axially in a series;

the second baffle has two baffle members arranged axially in a series; and each of the baffle members includes at least one annular baffle wall and at least one chamber.

20. The railed-tube ram accelerator of claim 16, wherein the first tube body is axially shorter than the second tube body.

21. The railed-tube ram accelerator of claim 18, wherein the first tube body is axially shorter than the second tube body, and wherein the second tube body is axially shorter than the third tube body.

22. The railed-tube ram accelerator of claim 12, wherein the central bore is smaller in diameter than the first and second projectile bores.

* * * * *